United States Patent [19]

Valentino

[11] 4,453,444

[45] Jun. 12, 1984

[54] KEY PADS

[76] Inventor: Pete P. Valentino, P.O. Box 6476, Stateline, Nev. 89449

[21] Appl. No.: 345,527

[22] Filed: Feb. 3, 1982

[51] Int. Cl.[3] ..... G10D 9/04

[52] U.S. Cl. ..... 84/385 P; 84/452 P

[58] Field of Search ..... 84/385 P, 397, 452 P

[56] References Cited

U.S. PATENT DOCUMENTS

| | | | |
|---|---|---|---|
| 1,681,220 | 8/1928 | Ciccone . | |
| 1,702,962 | 2/1929 | Buescher . | |
| 1,816,578 | 7/1931 | Hammann | 84/385 P |
| 2,264,591 | 12/1941 | Sander | 84/385 P |
| 2,400,592 | 5/1946 | Naujoks et al. . | |
| 2,471,290 | 5/1949 | Sommaruga . | |
| 2,534,660 | 12/1950 | Collis | 84/385 P |
| 2,540,760 | 2/1951 | Schoemann . | |
| 2,728,256 | 12/1955 | Melcher | 84/385 P |
| 2,957,381 | 10/1960 | Hillyard . | |
| 3,421,399 | 1/1969 | Greenleaf et al. . | |
| 3,501,991 | 3/1970 | Carruthers et al. . | |
| 3,691,892 | 9/1972 | Matsuura et al. . | |
| 3,958,484 | 5/1976 | Nelson et al. . | |
| 4,114,500 | 9/1978 | Norbeck | 84/385 P |

*Primary Examiner*—Lawrence R. Franklin

*Attorney, Agent, or Firm*—Browdy and Neimark

[57] ABSTRACT

A pad for the key cups of wind musical instruments for use in selectively sealing tone holes and spit holes, comprising a plastic disc made up of two layers, one of which is suited for sealing the hole and the other of which is less stiff and carries a layer of contact adhesive and a release paper. The invention is used by forcing the disc into the key cup which causes the paper to take a set on the inside concavity of the key cup thus exposing an annulus of adhesive coated surface. This annulus sticks to the sides of the key cup to securely hold the pad in place while automatically correcting for minor misalignments and the like. The pad is preferably made slightly oversized with respect to the key cup diameter.

12 Claims, 6 Drawing Figures

FIG. 1
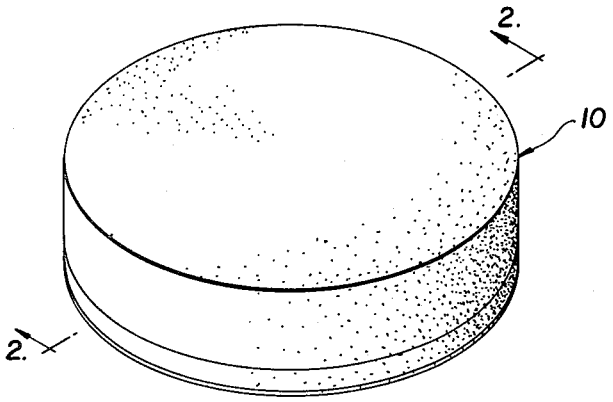
FIG. 3
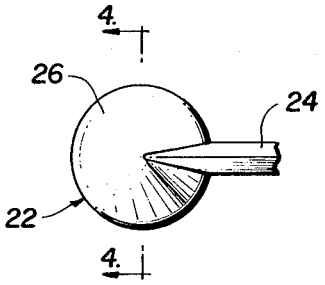
FIG. 2
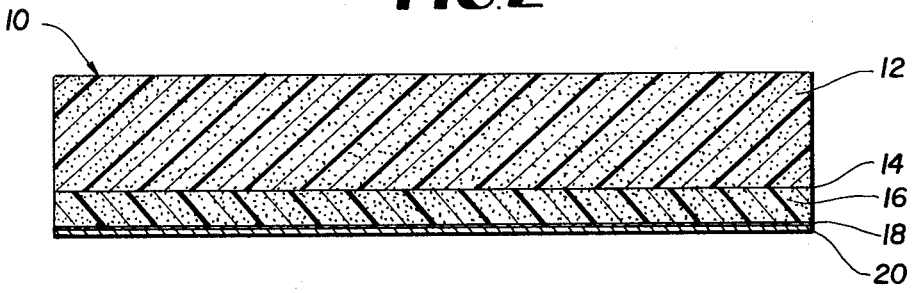
FIG. 4
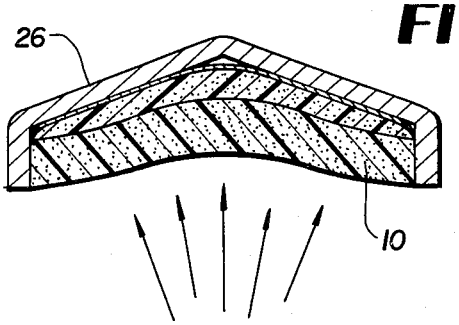
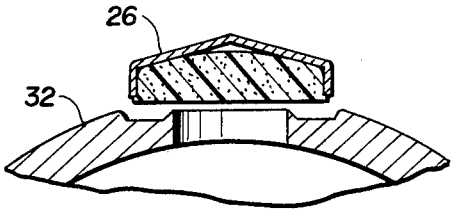
FIG. 5
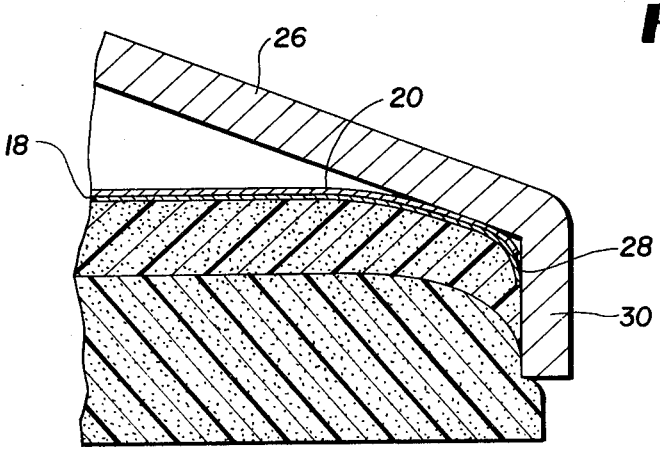
FIG. 6

KEY PADS

FIELD OF THE INVENTION

This invention relates to musical wind instruments, and, more in particular it pertains to an improved pad for use in various sorts of keys in such instruments.

Woodwind instruments such as clarinets, oboes, English horns, bassoons and the like all have a number of tone holes, each one of which is associated with a key having a pad which selectively seals and opens the hole. Brass instruments such as trumpets, trombones, tubas, and the like all have at least one water hole which is sealed by a key to allow the draining of water which accummulates in the instrument during use. This hole is called a "spit" hole.

The invention is applicable to all of such keys to provide an improved pad for use in conjunction therewith.

As to tone holes, the instrument is played by selectively opening one or combinations or these holes by use of these keys. It is vitally important that the holes be closed by the pads and tightly sealed against air leakage when they are not intentionally opened by the musician during his playing of the instrument. Even the smallest leakage will adversely affect the quality of the music produced, and also renders the instrument more difficult to play. In some cases, at an extreme, leakage can make the instrument completely unplayable. The problem of sealing the tone holes is of course complicated because each instrument includes a relatively large number of such tone holes.

The same and closely related problems arise with respect to the water hole key in brass instruments, and thus the use of the terms "key" and "key pads", and "pad", and the like as used in the specification and claims herein shall be understood to include such parts of all sorts of musical instruments to which the invention is applicable.

DESCRIPTION OF THE PRIOR ART

Musicians face numerous problems with respect to the key pads in their instruments, all of which problems are solved by the present invention. These problems include the heretofore necessary services of skilled instrument repairmen to replace the pads. Because of the frequent opening and closing of the key with which the pad is associated and the effect of saliva of the player, the pads normally deteriorate in use and must be periodically replaced. The reasons the services of the repairmen are required is that the pad when positioned in the key must be carefully aligned with the hole with which it is associated in order to seat properly. This problem is solved by the invention because of its self seating feature, described more in detail below.

Another related problem has to do with the cost of pads, both in and of themselves and with respect to the cost involved in engaging service personnel to change the pads. Such pads have been conventionally made as rather complex assemblages of parts. For example, in the case of clarinets, the tone hole key pads typically are made of a bottom circle of cardboard, which is covered by a wool circle pad, which is then covered on the outside by a thin fish skin. The fish skin destructs as the instruments are used, usually one to three years of use due to moisture penetration. Various means such as screws, glueing, and the like are used to hold such complex pads in place on the key on which they are mounted. Saxophone pads are similar to the pad described above, except that tanned leather is used, and they pads are typically glued into the key.

Further, conventionally, in order to manufacture such complex pads, the various parts thereof must be glued or otherwise assembled together, which often requires clamping for long periods of time, and other procedures requiring the skills of experienced fabricators and at substantial expense. The present invention solves this problem by providing an extremely inexpensive to manufacture pad, as described below.

Another problem in the prior art is that such complex assembled pads, when the skin deteriorates, the pad can absorb moisture, which seriously impairs its operation musically, and which hastens its further deterioration. The present invention solves this problem by its use of particular plastic materials which do not absorb water to a harmful extent and, when damaged, permit ready changing of themselves for new pads of the invention type by the musician himself in an extremely quick manner.

In this respect it is anticipated that a musician, faced with a leaking pad, could replace such a pad by himself during the intermission during a concert. This is an unheard of step forward in the art, such a problem would heretofore be solved by the musician taking up a new instrument and require sending of the damaged instrument to a repair shop depriving the musician of the use of the instrument for a week or so.

Another facet of the replacing of conventional pads is that the skilled repairmen must realign the keys. Because of the use of these particular plastic materials as taught by the invention, the pad, automatically and very accurately, seats itself on the tone hole or water hole in the instrument, thus automatically and inherently forming a tight seal. In the case of water hole key pads for brass instruments, cork or similar materials are typically used for the key pad. The present invention, because of its water resistant quality and sealing attributes is fully interchangeable with such cork key pads for brass instruments. The same advantage as is obtained with respect to woodwinds as to easy interchangeability and not requiring trips to the repair shop are also obtained for brass instrument water keys.

SUMMARY OF THE INVENTION

The present invention achieves these steps forward over the prior art and provides a key pad of the character described which is of low cost, easy to use by musicians themselves rather than repairmen, and which provides an important step forward in this art.

More in particular, the invention comprises a composite pad which consists of a disk stamped from sheet material which sheet material is made up of first and second layers of plastic material bonded together, with an adhesive coating on one side of one of the layers, and with a release paper on the exposed surface of the adhesive layer. The manufacture of such bonded sheets of plastic material with adhesive layers and release paper is an extremely well developed art per se, and the invention takes advantage of that technology in its application to key pads for musical instruments.

The invention offers great versatility in that virtually any plastic can be chosen for the first and second layers. Particular combinations of plastics have been found to be particularly advantageous for these uses in key pads for tone holes and in key pads for water holes.

Further, since the fabrication comprises merely stamping out circles from the prepared sheets, many different sizes of keys can be accommodated by simply using different diameter circular punches on the prepared sheets.

Another important feature of the invention has to do with the manner of insertion and mounting of the key pad in the key. This is done, quite surprisingly, by leaving the release paper in place when pressing the key pad into the key. The keys are formed with concave bottoms, and the paper is forced all the way up into the concavity when first assembling the pad to the key. This pressing of the pad all the way up into the key causes the release paper outer coating to take a permanent cup-like set. In so doing, the paper moves away from an annular edge, or donut shaped area around the adhesive coated face of the key pad. The thus exposed adhesive covered annulus of the inner face of the key pad is caused to stick against the sides of the key cup. The paper does not interfere with the adhesion of this annular zone to the sides of the cup because the paper has taken a more or less permanent set when the pad was pushed into the cup. After the pressure, from the user's fingers, is removed from the pad, it snaps back leaving the adhesive annular zone adhered to the cup, leaving the paper more or less as it set up into the concavity, and permitting the outer thicker plastic layer to extend out from the cup into operative position in preparation for being seated against the tone or water hole in the instrument. Further, the advantageous manner of seating and sealing has been found to be enhanced by making the pads slightly oversized with respect to the cup. This increases the force of the annular adhesive coated edge against the side of the cup, and also permits the outer layer to expand beyond the cup to in turn further enhance the self-sealing and self-aligning qualitites of the outer thicker pad.

Another aspect of the invention involves making the contact adhesive carrying layer of less stiff material than the hole sealing layer. This, together with the slight oversizing, aids in causing the pad to secure itself inside the key cup to cause the pad and especially the adhesive coated annulus to bear up hard against the cylindrical wall of the key cup.

The self-aligning quality results in large measure from the particular plastic chosen for the relatively thick outer layer. Minor misalignments and irregularities in the pad with respect to the cup and in the key carrying the cup with respect to the instrument are automatically and inherently accommodated by this relatively thick outer layer. Further, the material of this layer is chosen so that it is water resistent to increase the useful life of the pad.

Further, long life becomes a less important quality since the pads are readily changed by the musician by simply "digging out" the old pad using any available instrument such as a match stick or a pencil or a toothpick or the like, and then pressing in a new pad.

It is anticipated that musicians will carry along with their instruments a supply of these different sizes of key pads needed by their particular instrument for ready and immediate changing in the event of need. This advantage is completely revolutionary in the art, the need for skilled service people being totally eliminated for routine changing of key pads. In fact, it is anticipated that music teachers and even children learning to play musical instruments can change their own key pads as required.

BRIEF DESCRIPTION OF THE DRAWINGS

The above and other advantages of the invention will be pointed out or will become evident in the following detailed description and claims, and in the accompanying drawing also forming a part of the disclosure, in which:

FIG. 1: is a perspective view of a key pad embodying the invention;

FIG. 2: is a cross-sectional view taken on line 2—2 of FIG. 1;

FIG. 3: is a top plan view of a key of a musical instrument with which the invention pad may be used;

FIG. 4: is a cross-sectional view of the key cup taken on line 4—4 of FIG. 3 and further showing the manner in which the invention pad is positioned;

FIG. 5: is a view similar to FIG. 4 after the pad is located in the cup and illustrating the manner in which it is used in playing the instrument; and FIG. 6: is an enlarged cross-sectional view similar to the right hand half of the key cup and pad shown in FIG. 5, approximately.

DETAILED DESCRIPTION OF THE PREFERRED EMBODIMENTS

Referring now in detail to the drawings, FIGS. 1 and 2 show a key pad 10 embodying the invention. As is shown best in FIG. 2, pad 10 comprises a first relatively thick layer of plastic material 12 which is bonded to a second middle relatively thinner layer 16 of plastic material by an adhesive 14.

Layer 16 is chosen to be of a material which is less stiff than layer 12 to aid in seating the pad in the key cup. Further, since plastics are used, the invention pad is inherently water resistent, which is very important in wind musical instruments.

As known to those skilled in the arts of plastic fabrication, relatively large sheets of material made up in accordance with the cross-sectional teaching of FIG. 2 can be formed and then readily stamped by simple circular dies to form pads such as shown in FIG. 1 of any desired diameter for use in musical instruments. It is this simplicity of manufacture which achieves many of the important advantages of the present invention as compared to the prior art of fabricating key pads using complex structures, molding, leather arts, and the like, all of which are totally eliminated by the invention key pad 10.

In the successfully constructed embodiments, layer 16 was formed of a closed cell foam which compresses readily into the cup, as shown in FIG. 4 and described below, and, in cooperation with the release paper 20, allows the creation of the annular ring of the contact adhesive 18 to adhere to the sides of the cup. The layer 12 is preferably formed of cross-linked ethylene vinyl acetate, which material is preferred because of its qualities of water resistance and its qualities of "memory", that is the taking of a set on the tone hole or water hole of the instrument in use, as well as other advantages inherent in these and other materials, well known to those skilled in the plastics and musical arts. The thicknesses of the layers 12 and 16, and the diameters of the pads 10, will of course be dictated by the requirements of the particular key and the particular instrument with which the invention pads are used. All of those parameters are readily adjusted in use by those skilled in these arts.

Since both layers 12 and 16 are made of plastic foam, the entire pad 10 is water resistant, which is highly desirable in a pad for wind musical instruments.

The differences in stiffness and resiliency of the two layers is helpful in the invention achieving its advantageous simplified method of mounting. Layer 16, after being forced into the key cup, expands radially outwardly vigorously, to thus enhance the tight and secure fit of the pad in the key cup.

It is possible, by suitable selection of materials, and especially where the key cup and therefore the pad required is relatively thin, to use only one thickness of plastic foam to both self seat on the hole and to carry the contact adhesive layer to mount the pad into the cup.

The release paper 20 is a typical type of material used for that purpose in related plastic material, it resembles a waxed brown paper, and is of conventional technology per se. The important qualities are that it takes a set when mounted in the cup, and that it slide away from the edge portion of the contact adhesive layer 18 to permit the modus operandi of the present invention as described below.

Referring now to FIG. 3, there is shown a stylized typical key 22 representative of either a tone hole key or a water hole key for all sorts of wind musical instruments, as described above. The key comprises an arm 24 which is operated by the musician in use, and a cup portion 26 at the end of the arm. Such keys are highly well developed and well known to those skilled in the art, and need not be described in any further detail herein.

Referring now to FIG. 4, squeezing and pressing as indicated by the row of upwardly pointing arrows, by hand, forces as much of the pad 10 into the cup as possible. When the pressure indicated by the arrows is released, the pad will take the configuration shown in FIGS. 5 and 6. The musically operative layer 12 will expand out beyond the key cup, while the release paper will take a cup-like set on the inside of the cup as shown in FIG. 6. This will cause the paper to slide back and away from an annular zone 28 of the contact adhesive layer 28, and will permit said zone 28 to adhere to the inside of the skirt or cylindrical wall 30 of the key cup 26. It is to be especially carefully noted that the release paper 20 remains in place on the contact adhesive layer 18 when the invention pad 10 is used. If the release paper were first removed, the invention would not operate as well, because the pad would tend to take the shape of the concavity inside of the cup 26, which could result in its not operating at all for the intended purpose of sealing the openings in musical instruments.

FIG. 5 illustrates the completed assembly of the pad 10 in the key cup 26, and further illustrates a typical tone hole region 32 in a musical instrument, such as a clarinet. The edge portion defining the rim of the tone hole is about to first strike the musically functional layer 12, after which it will impart a more or less permanent set to that layer. That procedure automatically and inherently accommodates minor misalignments of the entire key 22 with respect to the instrument, as well as, and in addition to if necessary, minor misalignments of the pad in the key cup. This flows froms the relative thickness of the layer 12 and the particular material of which it is formed, as discussed above, i.e., the invention self seating feature.

Numerous changes and modifications are possible within the teaching of the invention. For example, depending upon the development of other plastic materials, it is possible that a single layer in the place of the composite 12 and 16 could be used. Such a composite layer would have to have both the ability to cooperate with the contact adhesive layer 18 and qualities of the musically active layer 12. Another possible variation is to heat treat the surface of such a single layer which is to be coated with the contact adhesive so that it takes on a closed cell type structure to simulate the layer 16. Other changes and variations will present themselves to those skilled in these arts.

Another attribute of the invention pad is that it eliminates the necessity for resonators typically installed on saxophone pads which heretofore were believed to not diminish the resonance of the tones produced. These pads, without mechanical resonators, do not inhibit or absorb the sound.

While the invention has been described in detail above, it is to be understood that this detailed description is by way of example only, and the protection granted is to be limited only within the spirit of the invention and the scope of the following claims.

I claim:

1. A pad for use in a key cup of a wind musical instrument to selectively seal a hole formed in the musical instrument, comprising at least one layer of resilient material having first and second surfaces, said first surface being capable or resiliently deforming and taking a set for selectively and effectively sealing said hole in said musical instrument, said second surface being adapted to support a layer of contact adhesive, means to secure said pad into a key cup comprising a layer of contact adhesive on said second surface, a layer of release paper releasably adhering to said layer of contact adhesive opposite said second surface, said pad except for said release paper layer consisting substantially entirely of plastic material or materials, and wherein the areas of said layers are coextensive in size and shaped to be slightly larger than the inner diameter of the key cup in which the pad is intended to be used, whereby said pad is compressed upon being assembled into a key cup and then expands to be securely held in said key cup.

2. The combination of claim 1, wherein said at least one layer of resilient material comprises two layers of plastic foam secured together, the layer which includes said first surface consisting of a material adapted to cooperate with the hole in the musical instrument to selectively seal the hole, and the material of which the second layer is formed being selected to effectively carry the contact adhesive layer.

3. The combination of claim 2, wherein said second layer consists of a closed cell plastic foam.

4. The combination of claim 2, wherein said first layer consists of cross-linked ethylene vinyl acetate.

5. A method of making the pad of claim 2, wherein said pads and said key cups are of circular shape, comprising the steps of preparing sheets of said first and second layers secured together with said layer of contact adhesive on said second surface and said release paper on said contact adhesive, punching or stamping discs out of said composite sheets, and selecting the diameters of said discs to correspond to the predetermined desired diameters of said pads.

6. The combination of claim 1, wherein said pad consists substantially entirely of water resistent material.

7. The combination of claim 1, said second surface being less resilient and less stiff than said first surface.

8. A method of assembling the pad of any one of claims 1 to 6 into the key cup of a wind musical instrument comprising the steps of forcing and compressing said pad into said key cup with the release paper in place on the layer of contact adhesive and with the release paper facing the concavity inside of said key cup, utilizing said forcing and compressing step to deform said layer of release paper to cause it to take a more or less permanent set shape corresponding to the inside of the concavity of said key cup, and releasing the forcing and compressing force on said pad in said key cup to permit the resiliency of the pad to cause the pad to expand outwardly away from the key cup concavity towards the hole to be selectively sealed by the pad, whereby said pad is caused to adhere to the key cup by an annulus of said contact adhesive coated second surface which is exposed by the deformation of said layer of release paper.

9. The method of claim 8, wherein said pad and said key cup are of circular shape and said key cup is defined by a cylindrical wall, and said annulus of said contact adhesive coated second surface adheres to the inside of said key cup cylindrical wall.

10. An assemblage of a pad in a key cup of a wind musical instrument made by the method of claim 8.

11. The assemblage of claim 10, wherein said key and pad is used to selectively open and seal a tone hole in a woodwind musical instrument to permit the playing of said instrument.

12. The assemblage of claim 10, wherein said key and pad are used to selectively seal a spit hole in a brass musical instrument.

* * * * *